US007207746B1

(12) United States Patent
Legun

(10) Patent No.: US 7,207,746 B1
(45) Date of Patent: Apr. 24, 2007

(54) REMOTE BOAT LIFT SWITCH

(76) Inventor: Don Legun, 102 Possum Trot La. P.O.Box 182, Semora, NC (US) 27343

( * ) Notice: Subject to any disclaimer, the term of this patent is extended or adjusted under 35 U.S.C. 154(b) by 0 days.

(21) Appl. No.: 11/307,715

(22) Filed: Feb. 17, 2006

(51) Int. Cl.
*B63C 3/06* (2006.01)

(52) U.S. Cl. ..... 405/3

(58) Field of Classification Search ..... 405/3, 405/1

See application file for complete search history.

(56) References Cited

U.S. PATENT DOCUMENTS

| | | | | |
|---|---|---|---|---|
| 4,763,592 | A | 8/1988 | Russ | |
| 5,020,463 | A | 6/1991 | Franklin | |
| 5,287,821 | A | 2/1994 | Godbersen | |
| 5,427,471 | A | 6/1995 | Godbersen | |
| D359,947 | S | 7/1995 | Greene | |
| 5,593,247 | A | 1/1997 | Endres | |
| 5,908,264 | A | 6/1999 | Hey | |
| 5,988,941 | A * | 11/1999 | Sargent et al. | 405/3 |
| 6,554,533 | B2 * | 4/2003 | Godbersen | 405/3 |
| 6,695,533 | B1 * | 2/2004 | Bulmann | 405/3 |
| 6,935,807 | B2 * | 8/2005 | Becker | 405/3 |
| 7,059,803 | B2 * | 6/2006 | Floe et al. | 405/3 |
| 7,090,431 | B2 * | 8/2006 | Cosgrove et al. | 405/3 |

* cited by examiner

*Primary Examiner*—Frederick L. Lagman
(74) *Attorney, Agent, or Firm*—Starkweather & Associates; Michael W. Starkweather; Jason P. Webb

(57) ABSTRACT

A novel watercraft lifting system for raising a watercraft to different positions relative to water and docks at least includes: at least one motorized winch adapted to be coupled via lift cables to a watercraft lift, the watercraft lift adapted to carry the watercraft thereon; a control unit coupled to the motorized winch to control the operation of the motorized winch; a cable tension detector adapted to detect the tension in the lift cables, and coupled to the control unit; and a user control transmitter adapted to transmit user-chosen RF control signals to the control unit. The control unit further at least includes a receiver adapted to receive the RF control signals, and the cable tension detector indicates that a watercraft has reached a buoyant level when the tension in the lift cables fall below a predetermined threshold.

20 Claims, 1 Drawing Sheet

REMOTE BOAT LIFT SWITCH

BACKGROUND OF THE INVENTION

1. Field of the Invention

The present invention generally relates to lifts for raising and lowering watercraft.

2. Description of the Related Art

Covered watercraft lifts provide allow boaters and other recreational watercraft users to conveniently raise and lower watercrafts out of and into water. Prior art watercraft lifts normally require the watercraft user to press a spring-loaded button continuously—sometimes for many minutes at a time—until the proper boat position is ascertained by the user. Using such approaches, the user must either be in close proximity with the start and stop switches, or must have another party operate the "raise" and "lower" switches of the lift. It is desirable to operate such a lift without having to be physically next to the operation switches. It is further desirable to operate such a lift without having to continuously press the operation switches.

Compounding the above problems is the fact that prior art watercraft lifts and lifting systems do not provide a way for automatically lowering a watercraft to the correct height ("down" or "water" position) for actual watercraft use. This is in part caused by natural variations the target water depths. Similar problems exist with respect to automatically positioning watercraft in storage ("up") positions, and in "loading" positions.

SUMMARY OF THE INVENTION

The present invention has been developed in response to the present state of the art, and in particular, in response to the problems and needs in the art that have not yet been fully solved. Accordingly, the present invention has been developed to provide a novel watercraft lifting system for raising a watercraft to different positions relative to water and docks that at least includes: at least one motorized winch adapted to be coupled via lift cables to a watercraft lift, the watercraft lift adapted to carry the watercraft thereon; a control unit coupled to the motorized winch to control the operation of the motorized winch; a cable tension detector adapted to detect the tension in the lift cables, and coupled to the control unit; and a user control transmitter adapted to transmit user-chosen RF control signals to the control unit. The control unit further at least includes a receiver adapted to receive the RF control signals, and the cable tension detector indicates that a watercraft has reached a buoyant level when the tension in the lift cables fall below a predetermined threshold.

In a particular embodiment, the lifting system further includes a timer coupled between the tension detector and the control unit, the timer being started when the tension detector indicates that the watercraft has reached a buoyant level, and the timer indicating that to the control unit that the buoyant level has been reached upon the expiration of a predetermined time period Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
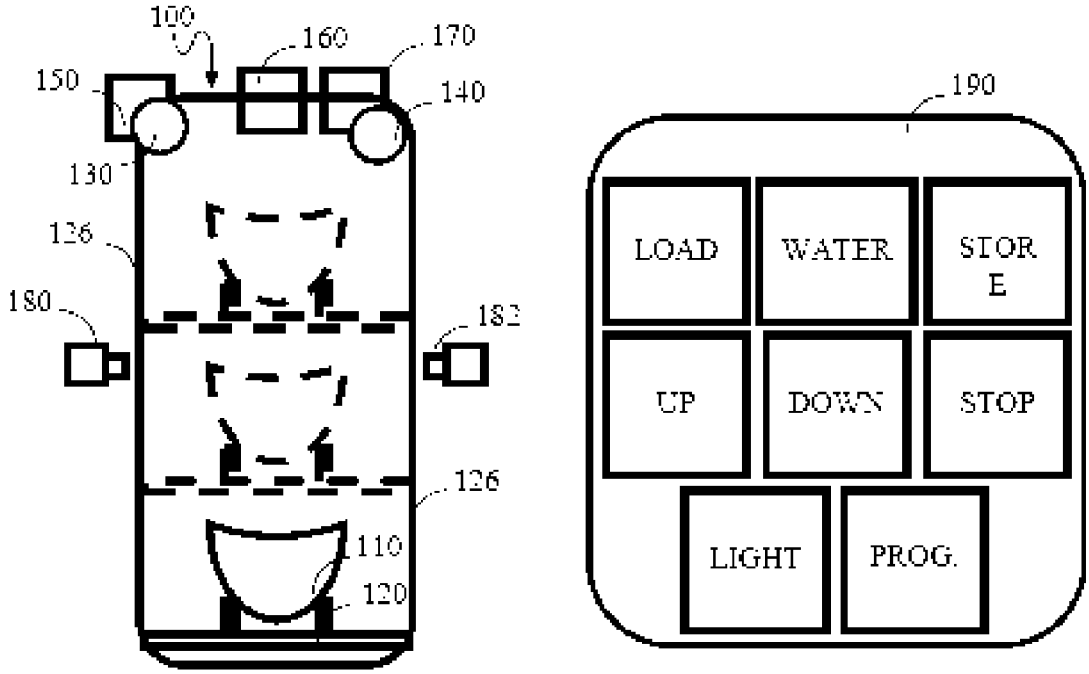
FIG. 1 shows front view of the present-inventive watercraft lifting system with a watercraft in a water or down position, the same watercraft in a middle or loading position, and the same watercraft in an up or store position, as well as a plan view of remote RF transmitter used by a user as part of the system.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

The present-inventive watercraft lifting system 100 illustrated in FIG. 1, novelly uses an RF remote controller 190 for lifting a watercraft 110 to various positions. Activating the appropriate control button on the remote 190 causes the lifting system to carry out the appropriate "raise" or "lower" operations, without the need for constant finger pressure. Further, the watercraft positions are automatically reached as described below.

A cable supported (i.e., cables 126) lifting dock 120 is used to raise and lower the watercraft 110 to various heights with the aid of winches and pulleys 130 and 140. The winches are powered by a reversible motor 150, with its power and control supplied via a control box 160.

The correct "down" or "water" position is automatically determined when the tension in the cables 126 falls below a threshold (i.e., the cables begin to slack). This is determined by a tension detector 170. The low tension (or non-tension) condition corresponds to a floating watercraft, as the cables are no longer needed for direct support. Since, however, water currents and waves may cause variations in a safe height for disengaging the lift, additional lowering of the lift is continued for a safe interval of time (e.g., several seconds, or a time which is a matter of design choice). An automatic timer begins counting when the cable tension falls below the predetermined threshold. Upon reaching a predetermined count corresponding to the passage of the safe time interval and safe margin of error needed for the lift to safely disengage from the bottom of the watercraft in choppy water conditions, the control box halts the movement of the motorized winches.

The loading position (a height conducive to allowing boaters to efficiently enter and leave the watercraft) of the watercraft is preset by the user during initial calibrations, but can be changed as desired. The store or up position of the watercraft is also set during initial calibrations, and can likewise also be changed as desired.

The position of the watercraft is determined by position sensors 180 and 182. Those skilled in the art will appreciate that given the teachings of the present invention, the position sensors can be optical, hall-effect type, mechanical switches, laser, and a host of other varieties. The position sensors can as a matter of design choice look for and/or count the presence of distinctive markings or characteristics of the lifting hardware to determine movement and positioning of the lift, as will be appreciated by those skilled in the art.

Figure 2:
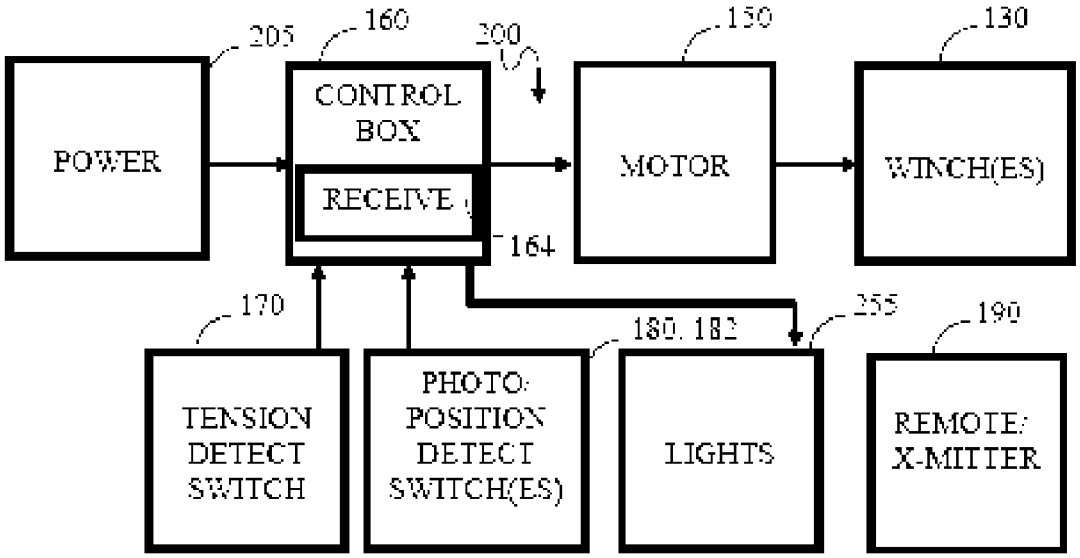
FIG. 2 shows a schematic block diagram of the present-inventive watercraft lifting system.

A schematic block diagram 200 of the present-inventive watercraft lifting system is illustrated in FIG. 2. A power source 205 supplies power to the system. Power to the motor and other control signals are supplied via the control box 160. Among the control box's many components are a receiver 164 for receiving RF control signals from a user's remote 190. The remote can be comparable in size to those used for automobiles. As can be seen from the diagram, the motor 150 drives one or more winches 130. When the tension detector 170 determines that the lift cables are below a threshold, a control box timer (not shown) begins to count. When a predetermined timer count is reached, the control box deactivates power to the motor.

The position detectors (180, 182) also provide signals to the control box which result in the control box deactivating power to the motor when either the loading or store positions of the watercraft are reached.

An additional feature of the present invention is the inclusion of lights 255 which can be activated via the remote for proper illumination of the dock area during dark conditions.

It is expected that there could be numerous variations of the design of this invention.

Finally, it is envisioned that the components of the device may be constructed of a variety of materials.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Thus, while the present invention has been fully described above with particularity and detail in connection with what is presently deemed to be the most practical and particular embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A watercraft lifting system for raising a watercraft to different positions relative to water and docks, said system comprising:

at least one motorized winch adapted to be coupled via lift cables to a watercraft lift, said watercraft lift adapted to carry the watercraft thereon;

a control unit coupled to said motorized winch to control the operation of said motorized winch;

a cable tension detector adapted to detect the tension in said lift cables, and coupled to said control unit; and a user control transmitter adapted to transmit user-chosen RF control signals to said control unit;

wherein said control unit further comprises a receiver adapted to receive said RF control signals, and wherein said cable tension detector indicates that a watercraft has reached a buoyant level when the tension in said lift cables fall below a predetermined threshold.

2. The lifting system of claim 1, further comprising:

a timer coupled between said tension detector and said control unit, said timer being started when said tension detector indicates that said watercraft has reached a buoyant level, and said timer indicating that to said control unit that the buoyant level has been reached upon the expiration of a predetermined time period.

3. The lifting system of claim 1, further comprising:

at least one position detector coupled to said control unit, said position detector adapted to indicate to said control unit when a watercraft has reached predefined loading positions and storage positions.

4. The lifting system of claim 1, further comprising:

lighting directly under the control of said control unit, and indirectly under the control of said user via said user control transmitter.

5. The lifting system of claim 1, wherein said motorized winch at least includes a separate motor and one or more winches.

6. The lifting system of claim 3, wherein said position detector is of the photo sensing variety.

7. The lifting system of claim 3, wherein said position detector is of hall-effect sensing variety.

8. The lifting system of claim 3, wherein said position detector comprises an electromechanical switch.

9. A watercraft lifting system for raising a watercraft to different positions relative to water and docks, said system consisting essentially of:

at least one motorized winch adapted to be coupled via lift cables to a watercraft lift, said watercraft lift adapted to carry the watercraft thereon;

a control unit coupled to said motorized winch to control the operation of said motorized winch;

a cable tension detector adapted to detect the tension in said lift cables, and coupled to said control unit; and a user control transmitter adapted to transmit user-chosen RF control signals to said control unit; wherein said control unit further includes a receiver adapted to receive said RF control signals, and wherein said cable tension detector indicates that a watercraft has reached a buoyant level when the tension in said lift cables fall below a predetermined threshold.

10. The lifting system of claim 9, further consisting essentially of: a timer coupled between said tension detector and said control unit, said timer being started when said tension detector indicates that said watercraft has reached a buoyant level, and said timer indicating that to said control unit that the buoyant level has been reached upon the expiration of a predetermined time period.

11. The lifting system of claim 9, further consisting essentially of:

at least one position detector coupled to said control unit, said position detector adapted to indicate to said control unit when a watercraft has reached predefined loading positions and storage positions.

12. The lifting system of claim 9, further consisting essentially of:

lighting directly under the control of said control unit, and indirectly under the control of said user via said user control transmitter.

13. The lifting system of claim 9, wherein said motorized winch includes a separate motor and one or more winches.

14. The lifting system of claim 11, wherein said position detector is of the photo sensing variety.

15. The lifting system of claim 11, wherein said position detector is of hall-effect sensing variety.

16. The lifting system of claim 11, wherein said position detector comprises an electromechanical switch.

17. A watercraft lifting system for raising a watercraft to different positions relative to water and docks, said system consisting of:

at least one motorized winch adapted to be coupled via lift cables to a watercraft lift, said watercraft lift adapted to carry the watercraft thereon;

a control unit coupled to said motorized winch to control the operation of said motorized winch;

a cable tension detector adapted to detect the tension in said lift cables, and coupled to said control unit; and a user control transmitter adapted to transmit user-chosen RF control signals to said control unit;

wherein said control unit further includes a receiver adapted to receive said RF control signals, and wherein said cable tension detector indicates that a watercraft has reached a buoyant level when the tension in said lift cables fall below a predetermined threshold.

18. The lifting system of claim 17, further consisting of:

a timer coupled between said tension detector and said control unit, said timer being started when said tension detector indicates that said watercraft has reached a buoyant level, and said timer indicating that to said control unit that the buoyant level has been reached upon the expiration of a predetermined time period.

19. The lifting system of claim 17, further consisting of: at least one position detector coupled to said control unit, said position detector adapted to indicate to said control unit when a watercraft has reached predefined loading positions and storage positions.

20. The lifting system of claim 17, further consisting of: lighting directly under the control of said control unit, and indirectly under the control of said user via said user control transmitter.

* * * * *